US009229431B2

(12) United States Patent
Briswalter et al.

(10) Patent No.: US 9,229,431 B2
(45) Date of Patent: Jan. 5, 2016

(54) REMOVABLE CROWN

(71) Applicant: Meco S.A., Grenchen (CH)

(72) Inventors: Sebastien Briswalter, Pfetterhouse (FR); Manuela Zingg, Ipsach (CH)

(73) Assignee: Meco SA, Grenchen (CH)

( * ) Notice: Subject to any disclaimer, the term of this patent is extended or adjusted under 35 U.S.C. 154(b) by 0 days.

(21) Appl. No.: 14/105,516

(22) Filed: Dec. 13, 2013

(65) Prior Publication Data

US 2014/0169144 A1 Jun. 19, 2014

(30) Foreign Application Priority Data

Dec. 18, 2012 (EP) ..... 12197843

(51) Int. Cl.
*G04B 3/06* (2006.01)
*G04B 3/04* (2006.01)
*G04B 37/10* (2006.01)

(52) U.S. Cl.
CPC *G04B 3/06* (2013.01); *G04B 3/041* (2013.01); *G04B 37/103* (2013.01); *Y10T 29/49586* (2015.01)

(58) Field of Classification Search
CPC ..... G04B 3/02; G04B 3/04; G04B 3/06; G04B 37/081; G04B 37/10; Y10T 29/49586
USPC ..... 368/288–290, 306–308, 319
See application file for complete search history.

(56) References Cited

U.S. PATENT DOCUMENTS

| | | | | |
|---|---|---|---|---|
| 5,617,377 | A * | 4/1997 | Perret, Jr. | 368/282 |
| 7,255,473 | B2 * | 8/2007 | Hiranuma et al. | 368/288 |
| 2006/0158967 | A1 * | 7/2006 | Hiranuma et al. | 368/318 |
| 2007/0147186 | A1 * | 6/2007 | Morel | 368/319 |
| 2009/0003142 | A1 * | 1/2009 | Hiranuma | 368/319 |
| 2013/0100782 | A1 * | 4/2013 | Cattaneo et al. | 368/308 |
| 2013/0215724 | A1 * | 8/2013 | Hiranuma et al. | 368/319 |

FOREIGN PATENT DOCUMENTS

| | | | |
|---|---|---|---|
| CH | 247 035 | | 2/1947 |
| CH | 291 565 | | 6/1953 |
| CH | 655 826 | A3 | 5/1986 |
| EP | 0 655 664 | A1 | 5/1995 |
| EP | 1 124 167 | A1 | 8/2001 |
| EP | 1 701 225 | A1 | 9/2006 |
| WO | WO 2012/168243 | A1 | 12/2012 |

OTHER PUBLICATIONS

English Translation of Wenger, EP 1701225, Electronic Translation retrieved Oct. 7, 2014*
English Translation of Wagen, EP 1124167, Electronic Translation retrieved Oct. 7, 2014.*
European Search Report issued Jul. 17, 2013 in EP Application 12197843, filed on Dec. 18, 2012 ( with English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

Crown including a cap formed of a cover integral with a lateral skirt, wherein the crown includes a removable deck ring.

16 Claims, 3 Drawing Sheets

REMOVABLE CROWN

This application claims priority from European Patent Application No. 12197843.1 filed Dec. 12, 2012, the entire disclosure of which is incorporated herein by reference.

FIELD OF THE INVENTION

The present invention concerns a timepiece crown which can be removed, particularly in order to change a sealing gasket.

BACKGROUND OF THE INVENTION

Crowns are commonly used as adjusting members for mechanical watches. Mounted on a tube which is driven or screwed into the middle part of the watch case, crowns are assembled at the end of a winding or control stem, and can take several distinct axial positions in which they can execute various types of functions, such as for example winding the barrel of the watch, setting the time, adjusting the date etc.

Screw-in crowns are commonly used for watches in order to improve the sealing of watches on their winding or control stem. This type of crown has the peculiarity of having to be in an unscrewed position to be capable of being actuated, in which the axial position of the crown can be changed to define an adjustment mode. In the screwed-in position, the crown is locked onto a tube, which is fixed inside the middle part and which preferably has a bulged part at the base of the portion thereof projecting outside the middle part of the case, in order to compress a sealing gasket, thereby improving the sealing of the watch. The screwed-in position is therefore the normal position when the watch is being worn and which has the best sealing properties, suitable, in particular, for use during aquatic activities, such as deep sea diving.

There exist several known manufacturing and assembling methods for assembling these screw-in crowns onto the middle part of a watch. There even exist angular orientation adjustment devices for placing the crown in a determined position relative to the case after the crown has been screwed-in, when there is a marking affixed to the end surface of the crown. This is the case, for example when the crowns are fitted to luxury and high quality goods.

Most crowns, regardless of whether or not they are screwed-in and orientable, generally include a cap formed by a cover on the top surface of which a trademark or logo can be affixed, and a lateral skirt inside which the securing tube is housed. To guarantee the sealing of this type of crown with respect to the tube, one or more sealing gaskets are provided on the lower end of the skirt, and are radially compressed between the external surface of the tube and the skirt, and covered by means of a crimped or driven-in ring. These covering rings, which are used to hold the sealing gasket axially when the crown is operated, are also commonly called "deck rings".

One drawback of these crowns is that sometimes it is impossible to replace a worn sealing gasket where the gasket is not accessible laterally when the crown is dismantled because the deck ring is permanently fixed to the bottom surface of the skirt of the crown. Consequently, during an after-sales service, for example, it may be necessary to replace the entire crown when its sealing properties deteriorate over time, which is very expensive.

EP Patent No. 0655664 proposes an alternative solution to deck rings for holding the sealing gasket of a crown-push button compressed against a guide tube by using an open, resilient, retaining ring engaged in a groove in the bottom face of the crown. These open resilient rings, also called circlips, are often employed as stop members for assembling and holding components in grooves about an arbour for larger sized parts, where the circlips are easy to handle using pliers which engage in holes at the ends thereof used for the assembly and removal of the circlips. However, the very reduced size of a timepiece crown, which is at most barely a few millimeters, makes the crown very difficult to handle, even simply to assemble, and particularly inconvenient for any subsequent dismantling operation. Moreover, the particular shape of the circlip requires a groove to be arranged in the bottom end of the crown skirt with a beak forming an axial retaining surface, as provided for in the invention disclosed by EP Patent No. 0655664, intended to prevent the circlip from being unintentionally wrenched out. This complicates the machining of the crown and therefore makes it more expensive to manufacture.

SUMMARY OF THE INVENTION

It is an object of the present invention to overcome the drawbacks of the aforementioned prior art by providing a conventional crown of simple, economical construction, which can be assembled without the use of any tedious operation of crimping a ring and/or handling a circlip, and can be more easily dismantled, without, however, impairing its sealing properties.

The invention therefore concerns a crown including a cap formed of a cover integral with a lateral skirt, characterized in that it includes a removable deck ring.

The invention also concerns a method of implementing the disassembly of the deck ring of this type of crown, characterized in that it includes a step of deforming the deck ring.

One advantage of the proposed solution is that it requires almost no structural modification of a conventional crown, or virtually any of the crown's components, to guarantee equivalent sealing and axial holding properties, yet allows a worn sealing gasket, for example, to be changed when the gasket is not laterally accessible.

Another advantage of the proposed solution is that it allows sealing gaskets to be set in place and replaced more rapidly on a crown.

BRIEF DESCRIPTION OF THE DRAWINGS

Other features and advantages of the present invention will appear more clearly from the following detailed description of preferred embodiments, given by way of non-limiting example, with reference to the annexed drawings, in which.

DETAILED DESCRIPTION OF THE INVENTION

Figure 1:
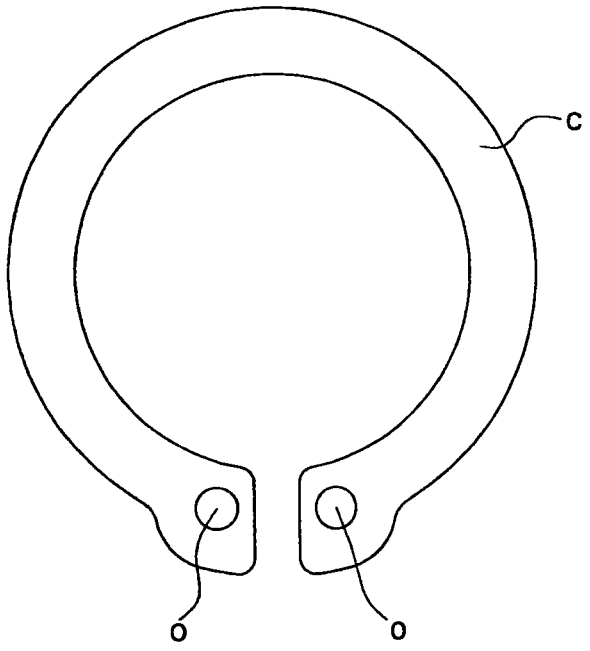
Fig. 1 PRIOR ART
FIG. 1 shows a known prior art circlip.

FIG. 1 shows a known prior art circlip C, which consists of an open resilient ring both ends of which adjoin each other in an assembled position to form a circular inner periphery matching the shape of a cylindrical arbour around which the circlip is intended to be fitted. To facilitate the assembly and disassembly of this type of circlip, apertures O are provided in lugs on the ends thereof to allow the circlip to be gripped and handled.

Within the scope of the invention, open circlips of this type are not used, but a closed ring, referred to below as a "deck ring", which is therefore more difficult to deform elastically for easy assembly and removal from its housing inside the crown without the risk of damaging the sealing gaskets or scratching the contours and sealing surfaces thereof.

Figure 2:
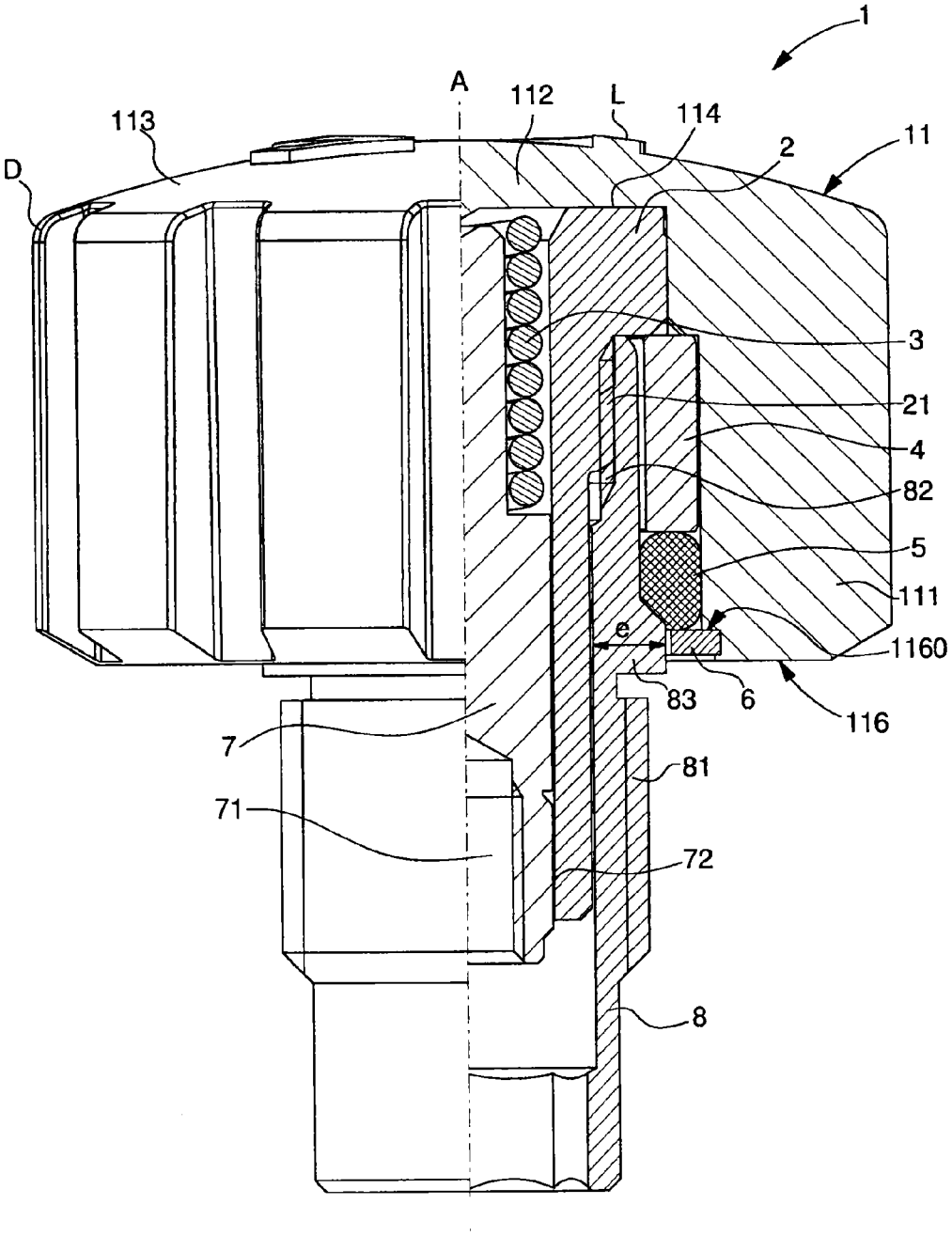
Fig. 2 PRIOR ART
FIG. 2 is a semi cross-section of a crown provided with a non-removable deck ring of the prior art.

FIG. 2 shows a sagittal semi cross-section along the axis of rotation A-A of a conventional screw-in crown 1, on which a logo L can be seen, which is "Omega" here, arranged on the external surface 113 of cover 112 of the cap 11. There is also shown, on the external periphery of the cap, a toothing D which is intended to make it easier for the user to grip crown 1 during use. Crown 1 is shown in the screwed-in position on a threaded tube 8, intended in turn to be screwed into the middle part of a watch case (not shown) by means of a first thread 81, while a tapping 82 cooperates with thread 21 of a central pipe 2 of tubular shape. Cap 11 is formed by a cover 112 and an axial skirt 111, which together define a central aperture 115 inside crown 1—referenced only in FIG. 3 described below for the sake of legibility—and in which there is arranged not only the end of threaded tube 8 integral with the middle part, but also central pipe 2. According to the illustrated embodiment, the central pipe 2 is integral with cap 11, but according to a variant it could consist of an intermediate element for controlling the angular orientation of cap 11 relative to the middle part of the watch.

Piston 7 housed inside central pipe 2 is integral with a stem (not shown but conventionally mounted on the bottom end 72 of piston 7? via tapping 71 in a blind hole) interacting with the movement. The piston can slide against a spring 3 stopped on an inner surface 114 of cover 112 of cap 11, and, in particular, enables cap 11 to emerge from the middle part when crown 1 is unscrewed from tube 2 when the crown is used to adjust a function (for example, to set the time, adjust the date or manually wind the movement).

A sealing gasket, typically an O ring joint, is inserted between threaded tube 8 and axial skirt 111 of cap 11 so as to guarantee sealing with respect to the crown tube. In the screwed-in position of crown 1, joint 7 is axially held between a cross-piece 4, which forms a first ring, and a non-removable deck ring 6, which forms a second ring covering the joint on the bottom face 116 of crown 1. Joint 1 is super compressed on a bulged portion 83 of tube 8, whose thickness matches the axial space e between non-removable deck ring 6 and central pipe 2, so that the sealing properties are the best possible when the crown is in the screwed-in position. After the crimping operation, non-removable deck ring 6 is housed inside a groove 1160 arranged in the bottom surface 116 of the crown so that it is virtually flush with the surface of bottom face 116 of crown 1.

Figure 3:
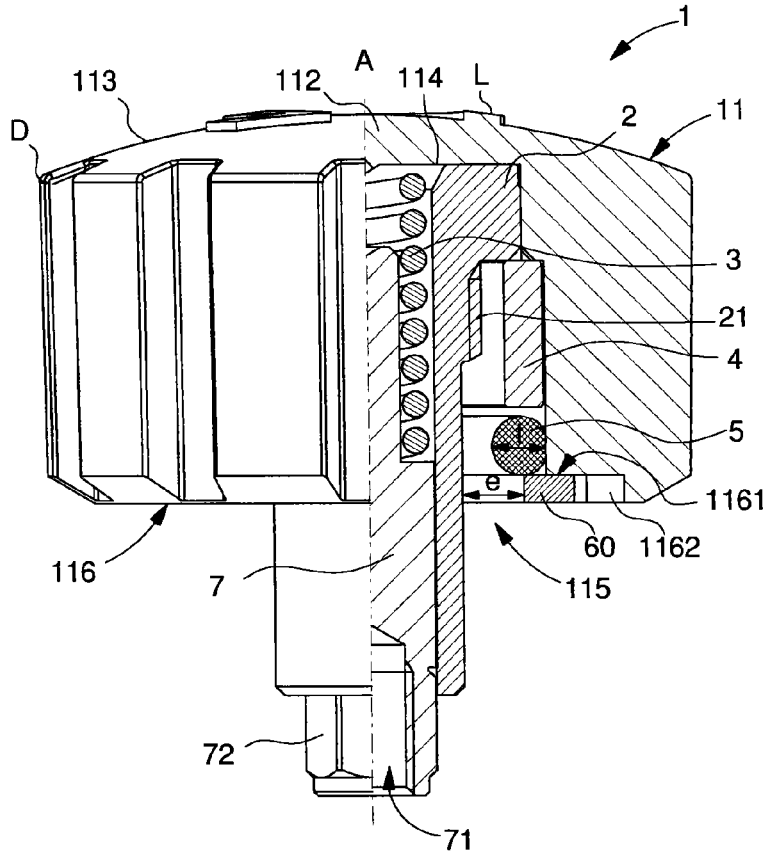
FIG. 3 is a view of a crown provided with a removable deck ring of the invention without its tube.

FIG. 3 shows a crown 1 according to the invention whose overall structure is identical to that illustrated in FIG. 2, but this time with tube 8 in a disassembled position, in which the deck ring is removable (referenced 60), i.e. it can be assembled on cap 11 and then subsequently dismantled. All the references are identical to those of FIG. 2, except those relating to tube 8 which is no longer shown, and to groove 1160 which has been replaced by a shoulder 1161, i.e. which no longer has an axial retaining surface. Sealing gasket 5 is now decompressed; it can be seen that it is doughnut-shaped, has a toroid diameter t, and the central aperture 115 can also be seen inside the crown, in which here is housed, in particular, central pipe 2. When the ratio between the axial space e available between the inner circumference of removable deck ring 60 and the external circumference of central pipe 2 of the crown is smaller than or equal to around 1.5 times the diameter of toroid section t, it is difficult to grip the sealing gasket through the inside of removable deck ring 60 to replace it without damaging it and thus impairing its sealing performance. Consequently, it may be useful or even necessary, to dismantle removable deck ring 60 beforehand.

Removable deck ring 60 can be mounted on cap 11 of crown 1 by a conventional driving in operation or by oval deformation. The walls of the crown and the deck ring may be cylindrical or conical. However, according to a preferred embodiment of the invention, the removable deck ring 60 is made in a shape memory material and it is then possible to deform the deck ring beforehand and to allow it to return to its original shape once placed on shoulder 1161 of the bottom face of crown 1, which both facilitates the deck ring assembling operations, and makes it possible to remove the deck ring without mutilating any elements or parts in proximity.

When removable deck ring 60 is made of a shape memory alloy, the alloy will preferably be chosen with a transition temperature situated well outside the working temperature range of the watch, comprised between around −20 and +50 degrees Celsius, to prevent any inadvertent dismantling of removable deck ring 60 in extreme use conditions. According to a preferred embodiment of the invention, the material is chosen to be Nitinol (50% nickel and 50% titanium), which has super elastic properties, i.e. of reversible deformation, around −30 degrees. The assembly operation may then consist in cooling the deck ring by applying a freezing spray, for example at −55 degrees, to bring it to a temperature at which it tolerates a deformation rate of more than 8%. By applying stresses to opposite points on a diameter of removable deck ring 60, for example using pliers, removable deck ring 60 is made slightly oval and it is placed in its housing on the bottom face of cap 11; it can therefore return to its original circular shape after around ten seconds at ambient temperature to hold sealing gasket 5 in place.

Figure 4:
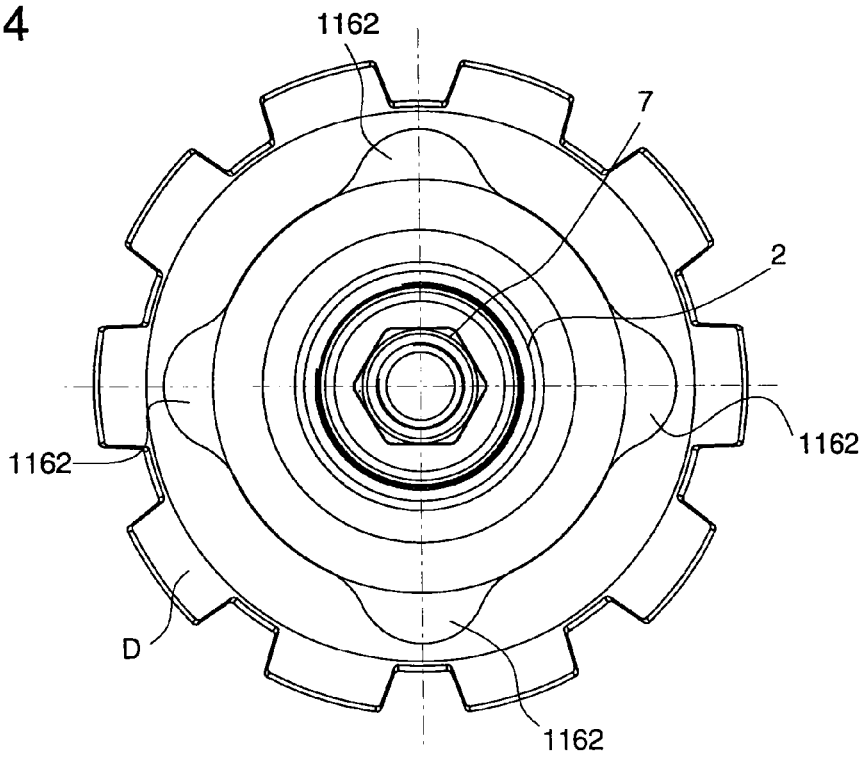
FIG. 4 shows a bottom view of the crown of FIG. 3, where the tube for fastening to the middle part is in a disassembled position, more particularly showing a particular gripping area provided for the removable deck ring.

To facilitate the assembly and disassembly operations, at least a first gripping area 1162 can be provided on the bottom face 116 of crown 1, referenced in FIGS. 2 and 4. According to the preferred embodiment illustrated for crown 1, a plurality of first gripping zones 1162 are provided, as seen in FIG. 4 which shows a bottom view of crown 1 and in which illustrates, in addition to toothing D of the crown, central pipe 2 and the hexagonal shape of the end of piston 7, four first gripping areas in the form of indentations respectively at midday, 3 o'clock, 6 o'clock and 9 o'clock in the bottom face of crown 116. Each of these indentations enables a tool for gripping removable deck ring 60 to be engaged and gripped from the exterior. The advantage of the arrangement of a plurality of these gripping areas, particularly in pairs along diameters of removable deck ring 60, is that removable deck ring 60 can be forced to become slightly oval during disassembly, when this operation requires manual intervention to deform the ring.

According to a variant, removable deck ring 60 can be made of a shape memory material which has been trained to have a two way memory effect, i.e. to have a first circular shape at ambient temperature in which it holds the sealing gasket in an assembled position on the cap, and a second shape, for example oval, in which it can be disassembled when it is brought to a temperature beyond the critical deformation threshold. In the case of Nitinol for example, the freezing spray would only need to be sprayed onto the crown in order to automatically disassemble the deck ring when its temperature falls below −30 degrees.

Figure 5:
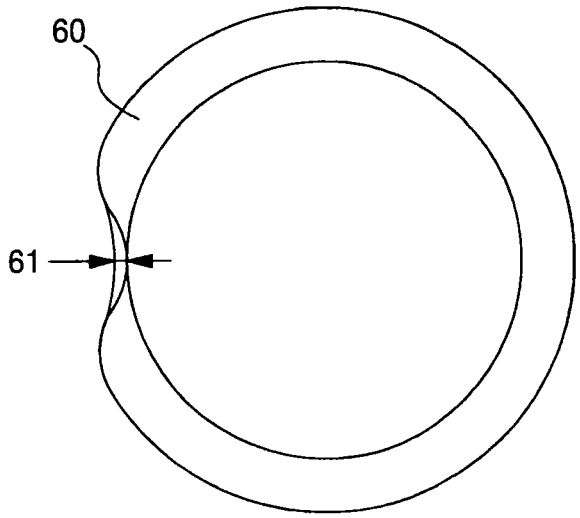
FIG. 5 is a view of a particular shape of a removable deck ring used according to an alternative embodiment of the invention.

Whichever method is chosen for assembling removable deck ring 60, when the latter is made of a shape memory material, the disassembly operation involves a plastic deformation which may be either manual or automatic after a preliminary heating or cooling step to take the deck ring beyond a critical temperature threshold above or below which it has super elastic properties. The deck ring is thus made removable without having to interact with other parts of crown 1, which allows sealing gasket 5 to be replaced more easily. According to an alternative embodiment, removable deck ring 60 is made easier to grip for the assembly or disassembly thereof not via gripping areas arranged on the crown, such as the first gripping areas 1162 illustrated in FIG. 4, but via second gripping areas arranged directly on the actual deck ring, such as indentation 61 seen in FIG. 5. As for the first gripping areas 1162, it may be advantageous to arrange these second gripping areas 61 in opposite pairs, along a diameter of removable deck ring 60 to make the latter easier to grip; however the arrangement of these indentations also weakens removable deck ring 60 during deformation.

Although the invention claimed has been described mainly in relation to the non-limiting example of a screw-in crown 1, it will be clear that the invention can be applied to any type of crown, and to any shape of deck ring 6, which may or may not be circular, to be fitted to different shapes of cap 11.

What is claimed is:

1. A crown for a timepiece comprising:

a cap formed of a cover integral with a lateral skirt, a sealing gasket, and a removable deck ring, wherein said deck ring axially holds said sealing gasket inside said cap, and wherein said deck ring is made of a shape memory alloy, wherein said deck ring is made removable by becoming more oval at a transition temperature.

2. The crown for a timepiece according to claim 1, wherein a transition temperature of the shape memory alloy is located well outside a working temperature range of a watch.

3. The crown for a timepiece according to claim 2, wherein the transition temperature is lower than −25 degrees Celsius.

4. The crown for a timepiece according to claim 3, the removable deck ring covering said sealing gasket, said sealing gasket being an O-ring joint of toroid cross-section diameter, and being arranged on a shoulder arranged in the bottom face of said cap, wherein a space smaller than or equal to 1.5 times the toroid cross-section diameter is available between the inner circumference of said removable deck ring and the outer circumference of a central pipe of said crown.

5. The timepiece crown according to claim 4, at least a first gripping area being provided for said removable deck ring on an exterior of the crown.

6. The timepiece crown according to claim 5, at least a second gripping area being arranged directly on said removable deck ring.

7. The crown for a timepiece according to claim 1, wherein said crown defines a shoulder for receiving said removable deck ring, said shoulder being free of an axial surface for retaining said removable deck ring such that said removable deck ring is exposed to an outside at an opening of said crown and is removable via said opening.

8. The crown for a timepiece according to claim 1, wherein said sealing gasket is decompressed.

9. The crown for a timepiece according to claim 1, wherein said shape memory alloy allows for deformation in radial directions with respect to said cap.

10. A method for assembling and disassembling a removable deck ring of a timepiece crown including a cap formed of a cover integral with a lateral skirt, a sealing gasket and a removable deck ring configured to hold said sealing gasket inside said cap, said removable deck ring being made of a shape memory material, wherein the method comprises plastically deforming said removable deck ring when assembling said removable deck ring against said sealing gasket and when removing said removable deck ring from said timepiece crown, and wherein said plastically deforming deforms said deck ring to be more oval.

11. The method for assembling and disassembling a removable deck ring of a timepiece crown according to claim 10, said deforming of said removable deck ring being achieved manually.

12. The method for assembling or disassembling a removable deck ring of a timepiece crown according to claim 11, said manually deforming of said removable deck ring being preceded by heating or cooling to place said removable deck ring at a temperature outside the working temperature range where said deck ring has an absolute deformation rate that can be reversibly recovered of up to 10%.

13. The method for assembling or disassembling a removable deck ring of a timepiece crown according to claim 10, said removable deck ring being made of a shape memory material trained to have a two way memory effect.

14. The method for assembling or disassembling a removable deck ring of a timepiece crown according to claim 13, said removable deck ring having a circular shape in the assembled position and an oval shape in the deformed position.

15. The method according to claim 10, wherein said removable deck ring is made of a shape memory alloy such that said removable deck ring deforms during said assembling and disassembling and returns to an original shape after said assembling and disassembling.

16. The method according to claim 10, wherein said shape memory material allows for deformation in radial directions with respect to said cap.

* * * * *